US009131786B2

(12) United States Patent
Leyden

(10) Patent No.: US 9,131,786 B2
(45) Date of Patent: Sep. 15, 2015

(54) MOUNT FOR ARTICLES ON HANGERS

(71) Applicant: Se-Kure Controls, Inc., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 14/591,533

(22) Filed: Jan. 7, 2015

(65) Prior Publication Data

US 2015/0190000 A1 Jul. 9, 2015

Related U.S. Application Data

(60) Provisional application No. 61/924,330, filed on Jan. 7, 2014.

(51) Int. Cl.
*A47F 7/00* (2006.01)
*A47F 5/00* (2006.01)
*A47F 7/19* (2006.01)

(52) U.S. Cl.
CPC ..... *A47F 5/0006* (2013.01); *A47F 7/19* (2013.01)

(58) Field of Classification Search
CPC ..... A47G 25/0607; A47G 25/1464; A47G 25/32; A47G 25/0692; A47G 25/1442; A45C 3/004; A47F 5/0006; A47F 7/19
USPC ..... 211/49.1, 59.1, 85.3; 206/300, 348, 206/279, 289, 290, 286, 90; D6/681
See application file for complete search history.

(56) References Cited

U.S. PATENT DOCUMENTS

| | | | | | |
|---|---|---|---|---|---|
| 229,838 | A | * | 7/1880 | Parker | 211/60.1 |
| 486,640 | A | * | 11/1892 | Gingras | 211/59.1 |
| 654,684 | A | * | 7/1900 | Smith | 211/85.3 |
| 808,864 | A | * | 1/1906 | McLaughlin | 402/67 |
| 1,022,980 | A | * | 4/1912 | Stringer | 211/7 |
| 1,072,179 | A | * | 9/1913 | Shea | 211/85.3 |
| 1,093,232 | A | * | 4/1914 | Wolf | 211/85.3 |
| 1,127,782 | A | * | 2/1915 | Kurtzon | 211/85.3 |
| 1,391,495 | A | * | 9/1921 | Parsons | 211/85.3 |
| 1,419,871 | A | * | 6/1922 | McDonald | 235/123 |
| 1,508,239 | A | * | 9/1924 | O'Brien | 211/59.1 |
| 1,527,243 | A | * | 2/1925 | Wells | 223/106 |
| 1,527,386 | A | * | 2/1925 | Barnard | 206/539 |
| 1,542,271 | A | * | 6/1925 | Ramsey | 211/85.3 |
| 1,717,078 | A | * | 6/1929 | Wheary | 211/85.3 |
| 1,909,429 | A | * | 5/1933 | Sherman | 206/354 |
| 1,918,310 | A | * | 7/1933 | Wheary | 206/290 |
| 2,182,488 | A | * | 12/1939 | Cowen | 211/59.1 |
| 2,205,298 | A | * | 6/1940 | Lindner | 211/59.1 |
| 2,206,564 | A | * | 7/1940 | Hallman | 206/289 |
| 2,284,518 | A | * | 5/1942 | Green | 273/148 R |
| 2,341,635 | A | * | 2/1944 | Loesch | 294/158 |
| 2,526,142 | A | * | 10/1950 | Koch | 206/298 |
| 2,530,609 | A | * | 11/1950 | Friedman | 211/49.1 |
| 2,626,062 | A | * | 1/1953 | Manzella | 211/59.1 |
| 2,656,913 | A | * | 10/1953 | Kaplan | 206/280 |
| 2,666,239 | A | * | 1/1954 | Farrell | 164/244 |
| 2,860,788 | A | * | 11/1958 | Hardman | 211/85.3 |

(Continued)

*Primary Examiner* — Joshua J Michener
*Assistant Examiner* — Devin Barnett
(74) *Attorney, Agent, or Firm* — Wood, Phillips, Katz, Clark & Mortimer

(57) ABSTRACT

An article mount upon which article carrying hangers are supported in a display state. The hangers and mount assembly are configured so that the hangers in the display state cannot be moved together to be separated from the article mount.

15 Claims, 5 Drawing Sheets

(56) References Cited

U.S. PATENT DOCUMENTS

| | | | | | |
|---|---|---|---|---|---|
| 3,191,770 | A | * | 6/1965 | Zuckerman | 206/300 |
| 3,266,688 | A | * | 8/1966 | Sefton | 294/158 |
| 3,299,997 | A | * | 1/1967 | Herz | 206/287.1 |
| 3,380,594 | A | * | 4/1968 | MacCluney | 211/85.3 |
| 3,464,588 | A | * | 9/1969 | Strike et al. | 221/75 |
| 3,661,268 | A | * | 5/1972 | Boley | 211/49.1 |
| 3,762,570 | A | * | 10/1973 | Tobin | 211/85.3 |
| 3,987,898 | A | * | 10/1976 | Crane | 206/300 |
| 4,104,972 | A | * | 8/1978 | Baublitz | 108/31 |
| 4,119,197 | A | * | 10/1978 | Pilz | 206/279 |
| 4,254,879 | A | * | 3/1981 | Maule | 211/4 |
| 4,342,389 | A | * | 8/1982 | Bethune et al. | 206/288 |
| 4,424,905 | A | * | 1/1984 | Keen | 211/49.1 |
| 4,640,414 | A | * | 2/1987 | Mobley et al. | 206/287 |
| 4,730,737 | A | * | 3/1988 | Robinson | 211/113 |
| 4,738,340 | A | * | 4/1988 | Crespi | 190/18 R |
| 4,753,342 | A | * | 6/1988 | Pulichino et al. | 206/291 |
| 4,769,878 | A | * | 9/1988 | Liao | 24/535 |
| 4,782,947 | A | * | 11/1988 | Sheiman | 206/279 |
| 4,869,408 | A | * | 9/1989 | Lutz | 224/417 |
| 5,076,447 | A | * | 12/1991 | De Beer | 211/123 |
| 5,180,057 | A | * | 1/1993 | Franklin | 206/279 |
| 5,373,979 | A | * | 12/1994 | Moore | 224/547 |
| 5,400,900 | A | * | 3/1995 | Myers et al. | 206/289 |
| 5,474,162 | A | * | 12/1995 | Shyr et al. | 190/18 A |
| 5,501,324 | A | * | 3/1996 | Franklin et al. | 206/279 |
| 5,505,297 | A | * | 4/1996 | Myers | 206/279 |
| 5,782,367 | A | * | 7/1998 | Aumasson | 211/124 |
| 5,833,184 | A | * | 11/1998 | Scola | 248/176.1 |
| 5,868,369 | A | * | 2/1999 | Montgomery | 248/214 |
| 5,876,009 | A | * | 3/1999 | Simoncioni, Jr. | 248/339 |
| 5,944,178 | A | * | 8/1999 | Mao | 206/289 |
| D417,802 | S | * | 12/1999 | Spurgeon et al. | D6/682.1 |
| 6,119,873 | A | * | 9/2000 | Matthews | 211/49.1 |
| 6,164,617 | A | * | 12/2000 | Butterfield et al. | 248/690 |
| 6,182,841 | B1 | * | 2/2001 | Klein | 211/85.14 |
| 6,230,904 | B1 | * | 5/2001 | Licari | 211/49.1 |
| 6,334,558 | B1 | * | 1/2002 | Sher | 223/1 |
| 6,393,877 | B1 | * | 5/2002 | Church | 70/62 |
| 6,484,991 | B2 | * | 11/2002 | Sher | 248/316.5 |
| 6,520,349 | B2 | * | 2/2003 | Keen | 211/49.1 |
| D574,167 | S | * | 8/2008 | Hodge | D6/681 |
| D595,976 | S | * | 7/2009 | Gonzalez Arellano | D6/681 |
| D625,528 | S | * | 10/2010 | Sprague | D6/681 |
| 2003/0111657 | A1 | * | 6/2003 | Green | 256/45 |
| 2003/0213761 | A1 | * | 11/2003 | Sparkowski et al. | 211/85.3 |
| 2004/0181963 | A1 | * | 9/2004 | Morris | 34/103 |
| 2006/0113202 | A1 | * | 6/2006 | Bentley et al. | 206/300 |
| 2006/0207949 | A1 | * | 9/2006 | Keen | 211/49.1 |
| 2007/0181515 | A1 | * | 8/2007 | Levi et al. | 211/85.3 |
| 2007/0194063 | A1 | * | 8/2007 | Wu | 223/85 |
| 2008/0029470 | A1 | * | 2/2008 | Vickroy | 211/113 |
| 2008/0099419 | A1 | * | 5/2008 | Costa et al. | 211/105.1 |
| 2010/0006711 | A1 | * | 1/2010 | Roth | 248/97 |
| 2010/0243829 | A1 | * | 9/2010 | Stephens-De Alanis | 248/158 |
| 2011/0036793 | A1 | * | 2/2011 | Sauer et al. | 211/85.3 |
| 2011/0168584 | A1 | * | 7/2011 | Torrellas | 206/287 |
| 2012/0055893 | A1 | * | 3/2012 | Wisniewski | 211/85.3 |
| 2013/0062300 | A1 | * | 3/2013 | Drake | 211/183 |
| 2014/0202896 | A1 | * | 7/2014 | Perron et al. | 206/279 |

* cited by examiner 36
12a
5
5
40
30
38
15
9
22
14
10
42
20
18
9
44
17
17
16
24
12b

MOUNT FOR ARTICLES ON HANGERS

BACKGROUND OF THE INVENTION

1. Field of the Invention

This invention relates to security systems and, more particularly, to a security system with a mount for controlling the separation of articles displayed thereat on hangers.

2. Background Art

Numerous articles of clothing are displayed at point of purchase on hangers. Pants, such as blue jeans, are commonly displayed in this manner.

Heretofore, there generally has not been a significant investment made by retail shop owners in securing blue jeans and other types of pants against theft. However, as designer products become more abundant in stores, the need for security measures becomes more compelling. Individual jeans can cost hundreds of dollars. While this cost does not by itself justify investment in costly security systems, the need for security at some level becomes more appropriate given the combination of the relatively high individual cost of the articles and recent tactics used by thieves in absconding with these articles.

More specifically, thieves have taken to grabbing multiple pairs of pants that can be quickly separated from conventional displays and relatively compactly held, as between their arms, as they flee. Given current display systems, thieves can in a quick, single movement grab and separate a compactly displayed quantity of the pants from the display structures after which they might be removed from a store quickly and/or without detection.

The industry continues to seek out systems that protect this type of merchandise effectively and that can be installed at a cost that is justified based upon the anticipated merchandise loss numbers.

SUMMARY OF THE INVENTION

In one form, the invention is directed to the combination of an article mount and first and second article hangers. The article mount includes an elongate member mounted relative to a support. The elongate member has a peripheral surface extending along a length of the elongate member and a free end. The article mount further includes a blocking assembly with at least one component movable selectively to thereby change the blocking assembly between a loading state and a blocking state. The elongate member has a display length between the free end and a second location. The first and second article hangers and article mount are configured to cooperate so that: a) each of the first and second hangers in a display state is slidable guidingly along the peripheral surface over the display length; b) each of the first and second hangers in a display state is individually separable from the article mount by movement lengthwise of the elongate member in one direction up to the at least one component with the blocking assembly in the blocking state and against the at least one component as an incident of which the at least one component is moved to thereby change the blocking assembly into the loading state in which the first and second hangers are individually allowed to move past the at least one component and up to and past the free end of the elongate member; and c) movement of the first and second hangers in the display state together in a first relationship in the one direction up to and against the at least one component with the blocking assembly in the blocking state causes one of the first and second hangers to block movement of the at least one component to thereby preclude: i) changing of the blocking assembly from the blocking state into the loading state; and ii) movement of the first and second hangers in the first relationship in the one direction up to and past the free end of the elongate member.

In one form, the first and second article hangers each has a fully surrounded opening through which the elongate member extends with the first and second hangers in the display state.

In one form, the at least one component moves by pivoting around an axis relative to the elongate member.

In one form, the at least one component has an overall "U" shape with a base and spaced arms extending from the base.

In one form, the at least one component moves by pivoting around an axis relative to the elongate member and the axis extends through the base of the at least one component.

In one form, the at least one component resides within a recess in the elongate member.

In one form, the elongate member has a central lengthwise axis and the recess is formed radially through the peripheral surface.

In one form, the at least one component moves by pivoting around an axis relative to the elongate member. The at least one component has an overall "U" shape with spaced arms and is pivotable between: a) a first position where one of the arms projects radially outwardly from the peripheral surface and the blocking assembly is in the blocking state; and b) a second position wherein the other of the arms projects radially outwardly from the peripheral surface and the blocking assembly is in the loading state.

In one form, the at least one component is biasably urged into one of the first and second positions.

In one form, the at least one component is pivotable between first and second positions and the blocking assembly is in: a) the blocking state with the at least one component in the first position; and b) the loading state with the at least one component in the second position.

In one form, the first and second article hangers and article mount are configured so that each of the article hangers causes the at least one component to change from the second position into the first position as an incident of each of the hangers moving oppositely to the one direction past the free end of the elongate member into the display state.

In one form, the first and second hangers in the first relationship are abutted to each other.

In one form, the first and second hangers in the first relationship are spaced from each other in a direction lengthwise of the elongate member up to a first predetermined distance.

In one form, the hangers each has a flat shape.

In one form the first article hanger has a triangular shape.

In one form, the first article hanger has a continuous triangular shape extending around an opening and defining a rail.

In one form, the combination described above is provided in combination with an article of clothing wrapped against the rail.

In one form, the combination further includes a clip to squeeze the article of clothing against the rail.

In one form, the recess extends up to and through the free end of the elongate member.

In one form, the at least one component is adjacent to the free end of the elongate member.

DETAILED DESCRIPTION OF THE PREFERRED EMBODIMENT

Figure 1:
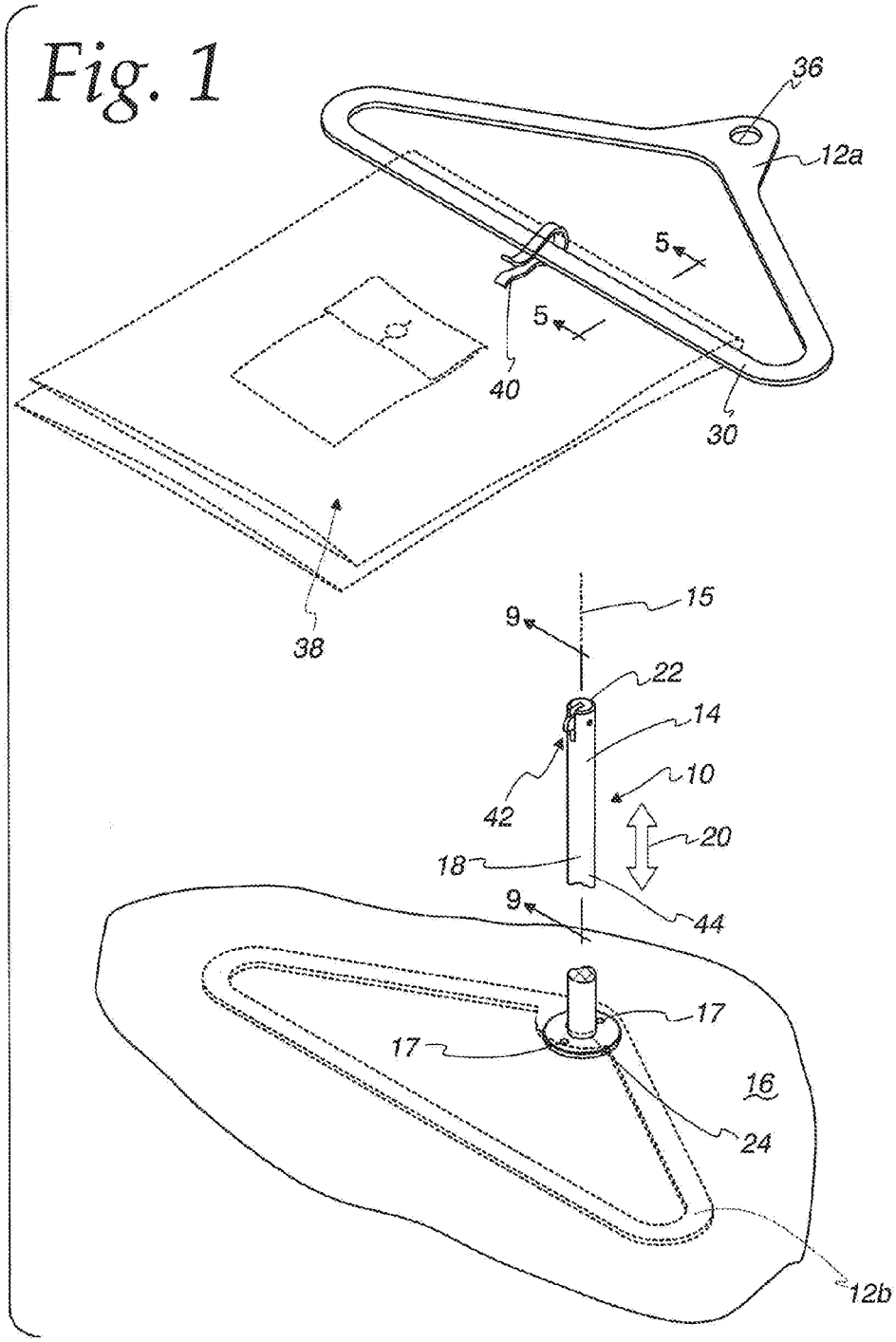
FIG. 1 is a perspective view of an article mount, according to the present invention, and one hanger for articles in a display state and a separate hanger with an article/pair of pants thereon and separated from the article mount.

In one form, the invention is directed to the combination of an article mount at 10 and a plurality of article hangers 12*a*, 12*b*.

The article mount 10 has an elongate member 14, with a central axis 15, that is rigidly cantilever mounted to a support 16 through suitable fasteners 17. While the support 16 is shown horizontally oriented, the support 16 may have any orientation between horizontal and vertical, as may be most appropriate for a particular display location and configuration. The elongate member 14 has a peripheral surface 18 extending along the length of the elongate member 14, as indicated by the double-headed arrow 20, between a free end 22 and a second location, in this case an opposite end 24.

The article hangers 12*a*, 12*b* have the same general construction, and one typical to conventional hangers. Exemplary article hanger 12*a* has a body 26 with a V-shaped portion 28 and a hanger rail 30 spanning between the legs 32, 34 of the "V" to define a continuous triangular shape extending around an opening 35. The apex of the "V" has a fully surrounded opening 36 formed thereat.

The hanger 12*b* has substantially the same configuration as the hanger 12*a*, with the exception that the opening 36', corresponding to the opening 36, is closer to its respective rail 30', whereby the rail 30' is offset from the rail 30 with the associated hangers 12*a*, 12*b* in a display state. This facilitates staggered, and potentially more compact, stacking of the pants/articles 38.

Figure 2:
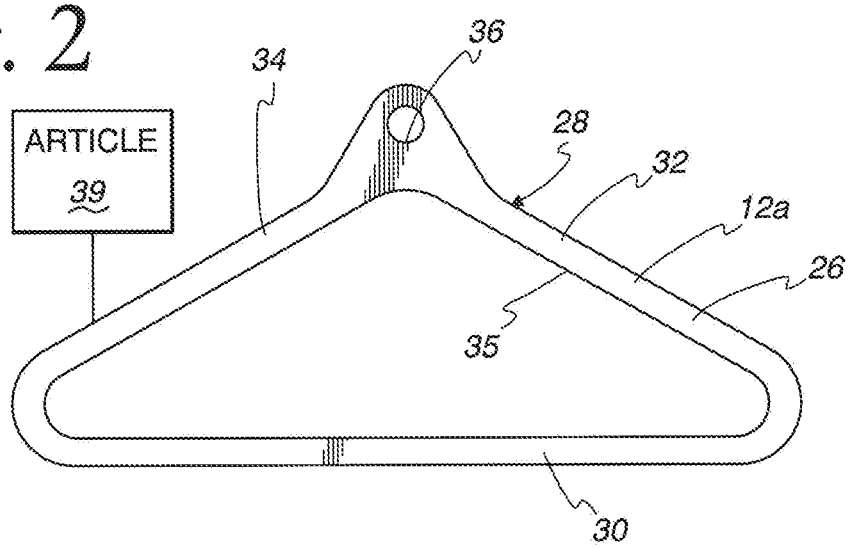
FIG. 2 is an elevation view of one of the article hangers shown in FIG. 1.
Figure 3:
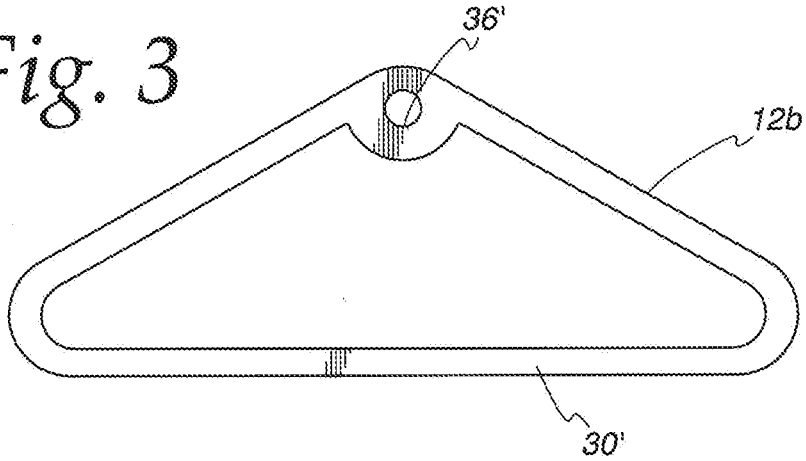
FIG. 3 is a view as in FIG. 2 of the other one of the article hangers shown in FIG. 1.
Figure 6:
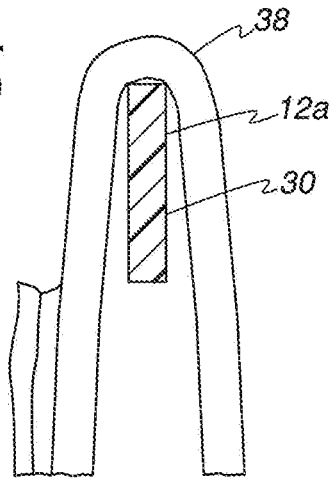
FIG. 6 is a view as in FIG. 5 with a pair of pants/article straddling the rail and without the clip.

The hangers 12*a*, 12*b* are configured so that any article, commonly supported on a hanger as shown schematically at 39 on the hanger 12*a* in FIG. 2, can be draped over the V-shaped portion 28 or placed to straddle the rail 30. While articles of different types, encompassed within the schematic showing, can be displayed using the invention, for purposes of this description, the exemplary article to be displayed will be a pair of pants 38, as shown in FIGS. 1 and 6, wrapped against the rail 30 to be borne thereagainst under the weight of the pants 38.

Figure 5:
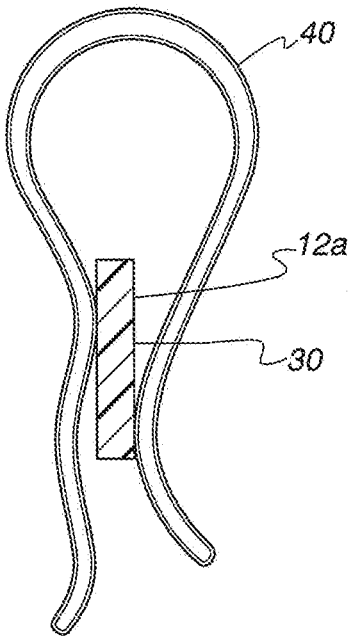
FIG. 5 is an enlarged, cross-sectional view of the rail on the hanger, taken along lines 5-5 of FIG. 2, with a securing clip placed thereon.

A flexible clip 40 can be pressed into place as shown in FIG. 5 to squeeze the pants 38 against the rail 30 to provide an additional degree of resistance to separation.

Figure 7:
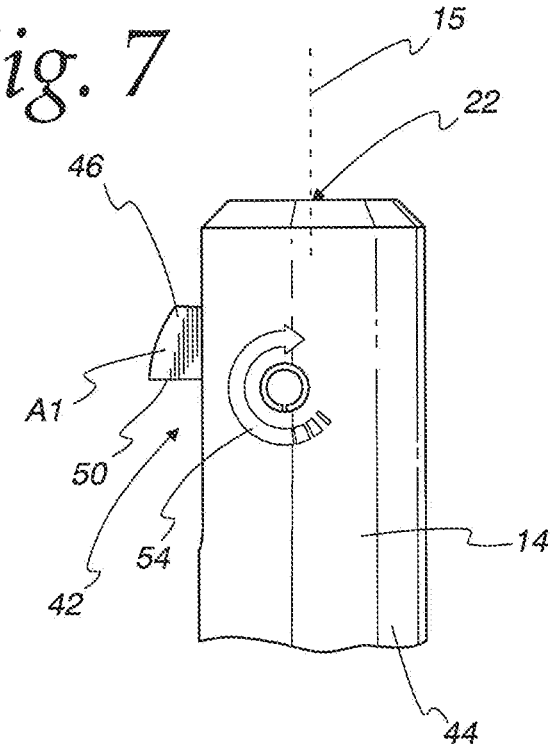
FIG. 7 is an enlarged, fragmentary, elevation view of a portion of the article mount with a blocking assembly thereon shown in a blocking state.
Figure 8:
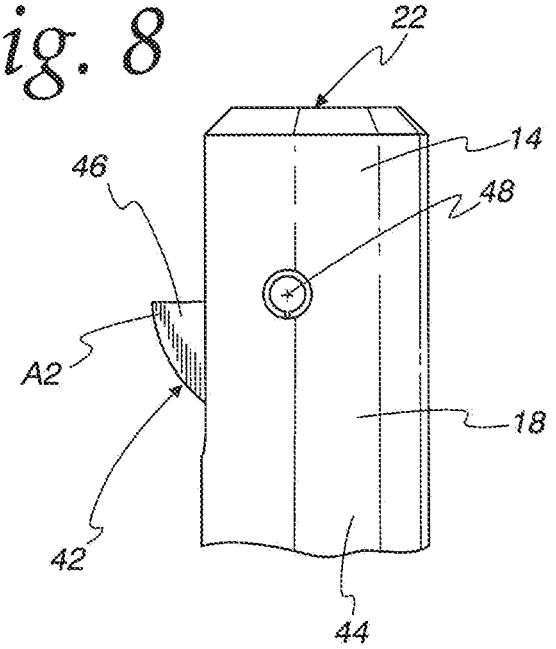
FIG. 8 is a view as in FIG. 7 with the blocking assembly in a loading state.
Figure 9:
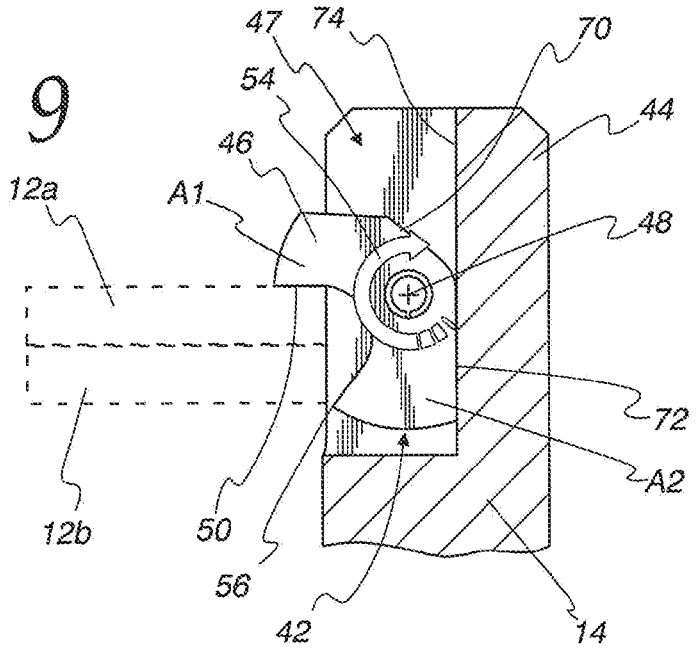
FIG. 9 is an enlarged, cross-sectional view of the article mount, taken along line 9-9 of FIG. 1, and showing the blocking assembly in the blocking state and in relationship to a pair of hangers in a display state on the article mount.
Figure 10:
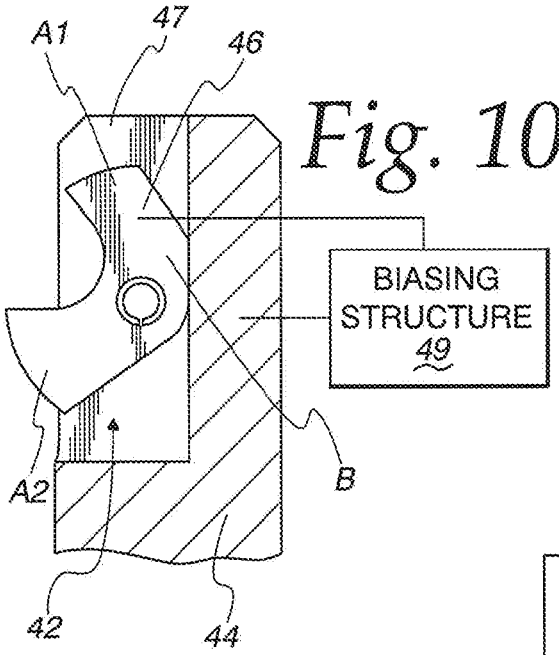
FIG. 10 is a view as in FIG. 9 with the blocking assembly changed into the loading state.

The article mount 10 further has a locking assembly 42 made up of at least one component that is selectively movable relative to a main body 44 on the elongate member 14 to thereby change the blocking assembly 42 selectively between a blocking state, as shown in FIGS. 1, 7, and 9, and a loading state, as shown in FIGS. 8 and 10. The blocking assembly 42 is adjacent to the free end 22 of the elongate member 14. The elongate member 14 has a display length between the location of the blocking assembly 42 and the second end 24.

In this embodiment, a single movable component 46 makes up the blocking assembly 42 and resides within a recess 47 extending radially through the peripheral surface 18 and up to and through the free end 22. Multiple components could, however, be utilized. In this embodiment, the component 46 has an overall "U" shape with a base B and spaced arms A1, A2 projecting from the base B.

The component 46 is pivotable about an axis 48 between a first position, as shown in FIGS. 7 and 9, wherein the blocking assembly 42 is in the blocking state, and a second position, as shown in FIGS. 8 and 10, wherein the blocking assembly 42 is in the loading state. The pivot location is at the base of the "U". A biasing structure 49 may be provided to normally urge the component 46 into one of the first and second positions with a force that must be overcome to move the component 46 into the other of the first and second positions. The component 46 may move under its own weight into one of the first and second positions.

The hanger opening 36 and peripheral surface 18 of the elongate member 14 are shown to be complementary and circular in shape. While this arrangement is preferred, it is not required. Virtually an unlimited number of different shapes might be utilized that may be fully or partially complementary. As just one example, the cross-sectional shapes may be triangular, or otherwise polygonally shaped. It is important that the hangers 12*a*, 12*b* be slidable lengthwise of the elongate member 14 from a fully separated state into a display state, and further, in the display state, that they be capable of cooperating with the blocking assembly 42, as hereinafter described. The hangers 12*a*, 12*b* can be released from their display state only by sliding them to and off of the free end 22.

With the hanger 12*a* in the display state, and the blocking assembly 42 in its blocking state, upward movement of the hanger 12*a* causes the hanger 12*a* to encounter an edge 50 on the one arm A1 on the U-shaped component 46. Continued upward movement of the hanger 12*a* causes the component 46 to pivot in the direction of the arrow 54 around the axis 48. The hanger 12*a* and component 46 are relatively configured so that this pivoting occurs without the hanger 12*a* significantly binding with the elongate member 14 or component 46 as the component 46 pivots between its first and second positions. As the second position for the component 46 is realized, the hanger 12*a* can be moved further fully past the blocking assembly and component 46 to separate from the free end 22.

In the event that one attempts to slide two of the hangers 12*a*, 12*b* together from their display state with the blocking assembly 42 in the blocking state, the trailing hanger 12*b* will block pivoting of the component 46, thereby precluding the blocking assembly 42 from changing from its blocking state into its loading state. More specifically, as seen in FIG. 9, as the leading hanger 12*a* encounters the edge 50 and imparts a force that induces pivoting in the direction of the arrow 54, an edge 56 on the arm A2 on the U-shaped component 46 is caused to abut the trailing hanger 12*b* to block further pivoting of the component 46 that would otherwise allow the hangers 12*a*, 12*b* to move past the component 46 to be fully separated at the free end 22.

As the component 46 changes between its first and second positions, one arm A1, A2 moves into the recess 47 while the other projects therefrom radially outwardly of the peripheral surface 18 to reside in the path of the hangers 12*a*, 12*b*.

In other words, the first and second article hangers 12*a*, 12*b* and article mount 10 are configured to cooperate so that: a) each of the first and second hangers 12*a*, 12*b* in a display state is slidable guidingly along the peripheral surface 18 over the display length; b) each of the first and second hangers 12*a*, 12*b* in a display state is individually separable from the article mount 10 by movement lengthwise of the elongate member 14 up to the component 46 with the blocking assembly 42 in the blocking state and against the component 46, as an incident of which the component 46 is moved to thereby change the blocking assembly 42 into its loading state in which the first and second hangers 12*a*, 12*b* are individually allowed to move past the at least one component up to and past the free end of the elongate member 14; and c) movement of the first and second hangers 12*a*, 12*b* in the display state together in a first relationship up to and against the component 46 with the blocking assembly 42 in the blocking state causes one of the first and second hangers 12*a*, 12*b* to block movement of the component 46 to thereby prevent: i) changing of the blocking assembly 42 from the blocking state into the loading state; and ii) movement of first and second hangers 12*a*, 12*b* up to and past the free end 22 of the elongate member 14.

Accordingly, the hangers 12*a*, 12*b* can be separated one-by-one with a predetermined spacing maintained therebetween but are precluded from being removed as a group of two or more. With this arrangement, a would-be thief would have to take the time to individually separate each of the articles 39/pants 38 with its associated hanger 12*a*, 12*b* from the article mount 10.

Each of the article hangers 12*a*, 12*b* is shown with a flat shape. The hangers may be molded to this shape or struck from a flat sheet.

Figure 4:
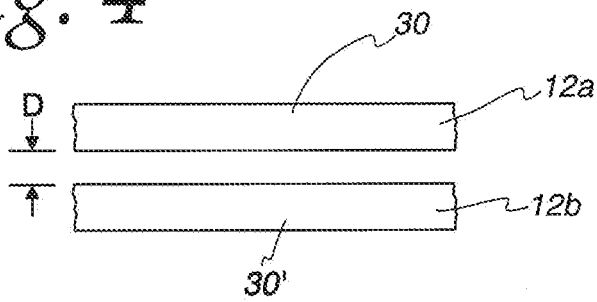
FIG. 4 is an enlarged, fragmentary, elevation view showing portions of hanging rails on the hangers in FIGS. 2 and 3 with the hangers in a display state on the article mount of FIG. 1.

As previously noted, the hangers 12*a*, 12*b* are precluded from moving together from their display state up to and past the free end of the elongate member 14 with the article hangers 12*a*, 12*b* in a first relationship. That relationship may be an abutting relationship as shown in FIG. 9, or alternatively a relationship as shown in FIG. 4, wherein the hangers 12*a*, 12*b* are spaced from each other in a direction lengthwise of the elongate member 14 up to a first predetermined distance D.

To operatively place the article hangers 12*a*, 12*b*, and other like hangers, the component 46 is initially placed in its second position, as shown in FIGS. 8 and 10. Downward movement of each of the hangers 12*a*, 12*b* individually causes the hangers to engage the arm A2 and thereby pivot the component 46 into the first position therefor, as shown in FIGS. 7 and 9, whereupon the hangers 12*a*, 12*b* can move over and past the component 46. This action is repeated each time a separate hanger 12*a*, 12*b* is changed from a fully separated state into the display state therefor.

As seen in FIG. 9, the component 46 has separate flats 70, 72 thereon that abut to a base edge 74, bounding the recess 47, to consistently and positively maintain the component 46 in each of its first and second positions.

Figure 11:
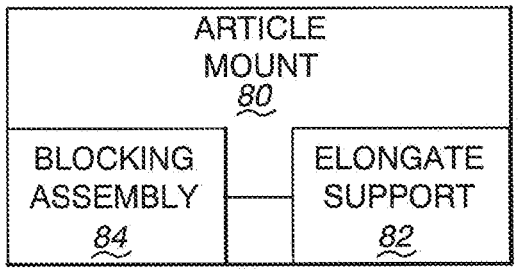
FIG. 11 is a schematic representation of an article mount, according to the invention.

While one specific form of the invention has been described hereinabove, this embodiment should not be viewed as limiting. As shown in FIG. 11, the invention contemplates a more generic construction made up of an article mount 80 with an elongate support 82 thereon having a blocking assembly 84. The generic showing is intended to encompass this specific embodiment and other embodiments wherein the components have a different construction and/or interact in different manners. What is significant is that the blocking assembly 84 cooperates with the article carrying hangers and elongate support 82 so that multiple hangers in a certain relationship cannot be moved together to be separated from the article mount 80. Within this generic showing is also a construction that would allow separation of only one of multiple hangers as they are moved together.

The foregoing disclosure of specific embodiments is intended to be illustrative of the broad concepts comprehended by the invention.

The invention claimed is:

1. An anti-theft display assembly comprising:

an article mount comprising an elongate member mounted relative to a support and having a peripheral surface extending along a length of the elongate member and a free end, the elongate member having a display length between the free end and a second location, the article mount further comprising a blocking assembly, the blocking assembly comprising at least one component movable selectively to thereby change the blocking assembly between a loading state and a blocking state; and first and second article hangers, the first and second article hangers and article mount configured to cooperate so that: a) each of the first and second hangers in a display state is slidable guidingly along the peripheral surface over the display length; b) each of the first and second hangers in the display state is individually separable from the article mount by movement lengthwise of the elongate member in one direction up to the at least one component with the blocking assembly in the blocking state and against the at least one component as an incident of which the at least one component is moved to thereby change the blocking assembly into the loading state in which the first and second hangers are individually allowed to move past the at least one component up to and past the free end of the elongate member; and c) movement of the first and second hangers in the display state together in a first relationship in the one direction up to and against the at least one component with the blocking assembly in the blocking state causes one of the first and second hangers to block movement of the at least one component to thereby preclude: i) changing of the blocking assembly from the blocking state into the loading state; and ii) movement of the first and second hangers in the first relationship in the one direction up to and past the free end of the elongate member, wherein a recess is formed in the elongate member and the at least one component resides within the recess, wherein the at least one component moves relative to the elongate member and the at least one component has spaced arms and is movable between: a) a first position where one of the arms projects radially outwardly from the peripheral surface and the blocking assembly is in the blocking state; and b) a second position wherein the other of the arms projects radially outwardly from the peripheral surface and the blocking assembly is in the loading state.

2. The assembly according to claim 1 wherein the first and second article hangers each has an aperture through which the elongate member extends when the first and second hangers are in the display state.

3. The assembly according to claim 1 wherein the at least one component is U-shaped with a base from which the spaced arms project and the axis extends through the base of the at least one U-shaped component.

4. The assembly according to claim 1 wherein the elongate member has a central lengthwise axis and the recess is formed radially through the peripheral surface.

5. The assembly according to claim 1 wherein the at least one component is biasably urged into one of the first and second positions.

6. The assembly according to claim 1 wherein the first and second article hangers and article mount are configured so that each of the article hangers causes the at least one component to change from the second position into the first position when each of the hangers moves past the free end of the elongate member into the display state.

7. The assembly according to claim 1 wherein the first and second hangers in the first relationship are abutted to each other.

8. The assembly according to claim 1 wherein the first and second hangers in the first relationship are spaced from each other in a direction lengthwise of the elongate member up to a first predetermined distance.

9. The assembly according to claim 1 wherein the hangers each has a flat shape.

10. The assembly according to claim 1 wherein the first article hanger has a triangular shape.

11. The assembly according to claim 1 wherein the first article hanger has a continuous triangular shape extending around an opening and defining a rail.

12. The assembly according to claim 11 in combination with an article of clothing wrapped against the rail.

13. The assembly according to claim 11 further in combination with a clip to squeeze the article of clothing against the rail.

14. The assembly according to claim 1 wherein the recess extends up to and through the free end of the elongate member.

15. The assembly according to claim 1 wherein the at least one component is adjacent to the free end of the elongate member.

* * * * *